US006621415B1

(12) United States Patent
Willis

(10) Patent No.: US 6,621,415 B1
(45) Date of Patent: Sep. 16, 2003

(54) SECURITY ALARM SYSTEM COMPONENT FOR SECURING MOVEABLE OBJECTS

(76) Inventor: Stanley D. Willis, 107 S. 79th Pl., Mesa, AZ (US) 85208

( * ) Notice: Subject to any disclaimer, the term of this patent is extended or adjusted under 35 U.S.C. 154(b) by 78 days.

(21) Appl. No.: 09/929,201

(22) Filed: Aug. 14, 2001

(51) Int. Cl.[7] ..... G08B 13/12
(52) U.S. Cl. ..... 340/568.2; 340/568.1
(58) Field of Search ..... 340/568.2, 568.1, 340/568.4, 539

(56) References Cited

U.S. PATENT DOCUMENTS

| | | | | |
|---|---|---|---|---|
| 883,335 | A | | 3/1908 | O'connor |
| 1,747,194 | A | | 2/1930 | Thomas |
| 3,253,270 | A | | 5/1966 | Downer |
| 3,444,547 | A | | 5/1969 | Surek |
| 3,576,265 | A | | 6/1971 | Garland |
| 3,754,224 | A | | 8/1973 | Roy |
| 3,781,861 | A | | 12/1973 | Adler, Jr. et al. |
| 3,914,756 | A | | 10/1975 | Seyk |
| 3,972,039 | A | | 7/1976 | Marshall |
| 4,204,100 | A | | 5/1980 | Reichert |
| 4,746,909 | A | | 5/1988 | Israel et al. |
| 4,920,334 | A | | 4/1990 | DeVolpi |
| 4,962,369 | A | * | 10/1990 | Close ..... 340/568.1 |
| 5,408,212 | A | | 4/1995 | Meyers et al. |
| 5,617,073 | A | * | 4/1997 | Wilson ..... 340/568.2 |
| 6,037,867 | A | | 3/2000 | Joseph et al. |
| 6,297,735 | B1 | * | 10/2001 | Abel ..... 340/568.2 |

OTHER PUBLICATIONS

Tom Harris, How Burglar Alarms Work www.howstuffworks.com.
Protech www.protechusa.com.
Visonic source unknown.

* cited by examiner

*Primary Examiner*—John Tweel
(74) *Attorney, Agent, or Firm*—Ellis & Venable, P.C.

(57) ABSTRACT

The invention is a security alarm system component (the "security component") for securing movable objects. The security, component is designed for use with an ordinary security monitoring system. The security component is threaded through objects sought to be secured. A looping block allows the user to complete the circuit without having to plug the end of the security component into a fixed location. Among other things, the looping block allows the user to secure movable objects of variable size and variable distance from the security monitoring system.

15 Claims, 2 Drawing Sheets

SECURITY ALARM SYSTEM COMPONENT FOR SECURING MOVEABLE OBJECTS

FIELD OF THE INVENTION

The present invention relates to home and business security alarm systems, particularly a security alarm system component for securing movable objects.

BACKGROUND

A common way to secure a home or business is to purchase and install a security alarm system. A basic security alarm system typically employs a control box connected to one or more alarm circuits. Each alarm circuit monitors various security points about the home or business. The alarm circuit can be triggered by opening a door, breaking a window or by movement in a certain area.

In many situations, a third party monitors the security alarm system from a remote location (referred to as the "third party monitor"). For example, if the security alarm system detects that a door is open, the system will notify the third party monitor that the door is open. The third party monitor will wait a specified period of time for the alarm to be deactivated by security code. If the alarm is not deactivated before the specified period of time elapses, the third party monitor will initiate a pre-defined alarm protocol. The alarm protocol typically includes notifying the owner and the local police.

The typical security alarm system works adequately for objects located within the walls of the home or business. On the other hand, the typical security alarm system cannot adequately secure movable objects located outside the walls of a home or business. Residential and commercial equipment is often stored outside. Examples of equipment that is often stored outside include: lawn mowers, motorcycles, bicycles, trailers, jet skis, boats, generators, and a variety of other inventory and equipment.

Current outdoor security alarm systems employ the use of a variety of motion sensors, including motion sensors that utilize microwave technology, passive infrared light technology, and photo-electric technology (collectively referred to as "motion sensors") to secure outdoor movable objects. Other information relevant to address the problem of securing outdoor movable objects and information relevant to address security issues in general can be found in U.S. Pat. Nos. 883,335 (O'Connor), 1,747,194 (Thomas), 3,253,270 (Downer), 3,444,547 (Surek), 3,576,265 (Garland), 3,754,224 (Roy et al.), 3,781,861 (Ader, Jr. et al.), 3,914,756 (Seyk), 3,972,039 (Marshall), 4,204,100 (Reichert), 4,746,909 (Isreal et al.), 4,920,334 (De Volpi), 5,408,212 (Meyers), 6,037,867 (Joseph). Motion sensors and each one of the referenced items, however, suffer from one or more of the following disadvantages.

Motion sensors are expensive to purchase, expensive to install and expensive to maintain especially motion sensors utilizing microwave technology, passive infrared light technology, or photoelectric technology. Motion sensors are susceptible to a high rate of false alarms due to malfunction, children, pets, wind moving objects into the motion sensor's view, and other false triggers. Motion sensors must be permanently mounted to a fixed object and can only protect a predefined specific area. Outdoor motion sensors deteriorate quickly from constant exposure to the elements.

Other references employ the use of a flexible conduit containing an electrical alarm circuit. These references also suffer from several disadvantages. First, the length of the conduit cannot be adjusted to fit varying conditions. As such, the conduit must protect the same sized element in the same general location all the time. For example, a fixed length electrical conduit could not be used easily to secure one bicycle one day and a fleet of bicycles the next day without having an excess conduit available. Second, the end of the flexible conduit must be returned to a fixed receptacle in order to complete the electrical circuit. When securing a movable object that is far away from the receptacle, or when securing a group of movable objects, the conduit must be long enough and flexible enough to thread through the objects being secured and still be long enough to plug into the fixed receptacle and complete the circuit. Third, it is simply inconvenient and cumbersome to have to loop the flexible conduit through each object being secured and have to plug the end of the conduit back into the fixed receptacle.

Presently, no security alarm system component for securing movable objects is known that (1) is relatively inexpensive, (2) is not prone to false alarm due to wind, pets, etc., (3) is adjustable in length so that it can easily accommodate different size objects that are both close and far away from the premises, (4) does not need to be plugged into a fixed receptacle to complete the electrical circuit or (5) conveniently unplugs so that the entire unit can be stored inside when not in use. For the foregoing reasons, a need exists for a security component that satisfies all of the above needs.

SUMMARY OF THE INVENTION

It is an object of the present invention to provide a relatively inexpensive security component for securing movable objects. Other objects of the invention include providing a security component that (1) can be adapted for use with most home and business security alarm systems, (2) is not prone to false alarm due to wind, pets, etc., (3) is adjustable in length so that it can easily accommodate different size objects, (4) does not need to be plugged into a fixed receptacle to complete the electrical circuit and (5) conveniently unplugs so that the entire unit can be stored inside when not in use.

Typically, homes and businesses employ a security alarm system having a control box, where the control box can, among other things, (1) apply an energy potential across a first conductor and a second conductor, (2) detect an alteration of energy flow across the first and second conductor, and (3) trigger an alarm after detecting the alteration of energy flow. The present invention is a security component for use with such a security alarm system. The security component comprises the following elements:

1. A flexible conduit that houses first and second conductors, wherein a first end of the flexible conduit, the first conductor, and the second conductor are connected to the control box;
2. A switch, wherein the terminals of the switch are connected to the first and second conductors near a second end of the flexible conduit;
3. A looping block having a conduit shaft and a looping shaft, where the conduit shaft fully penetrates the looping block so that the flexible conduit adjustably passes (or "slides") through the conduit shaft and the receiving shaft does not fully penetrate the looping block; and,
4. A switch actuator that is encapsulated within the looping block, wherein the switch actuator is an electrically isolated device that does not conduct electricity but the proximity of the actuator to the switch actuates the switch to alter the flow of energy through the first and second conductors when the second end of the flexible conduit is inserted into the receiving shaft.

To secure a movable object, the user of the security component connects the first end of the flexible conduit to the control box, usually by way of an outdoor junction box. The user threads the second end of the flexible conduit through the object or objects sought to be secured. The second end of the security component is then looped through one of the objects being secured or some other fixed object and then inserted into the receiving shaft. The user then arms the security component at the control box by having the control box apply an energy potential across the first and second conductors. Once the security component is armed, the secured objects cannot be removed without breaking the circuit or unless a user disarms the security alarm system at the control box.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function.

Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

The invention is a security alarm system component (the "security component") for securing movable objects. The security component can be used with a security alarm system having a control box, where the control box can (1) apply an energy potential across a first conductor and a second conductor, (2) detect an alteration of energy flow across the first and second conductor, and (3) trigger an alarm after detecting the alteration of energy flow.

Figure 2:
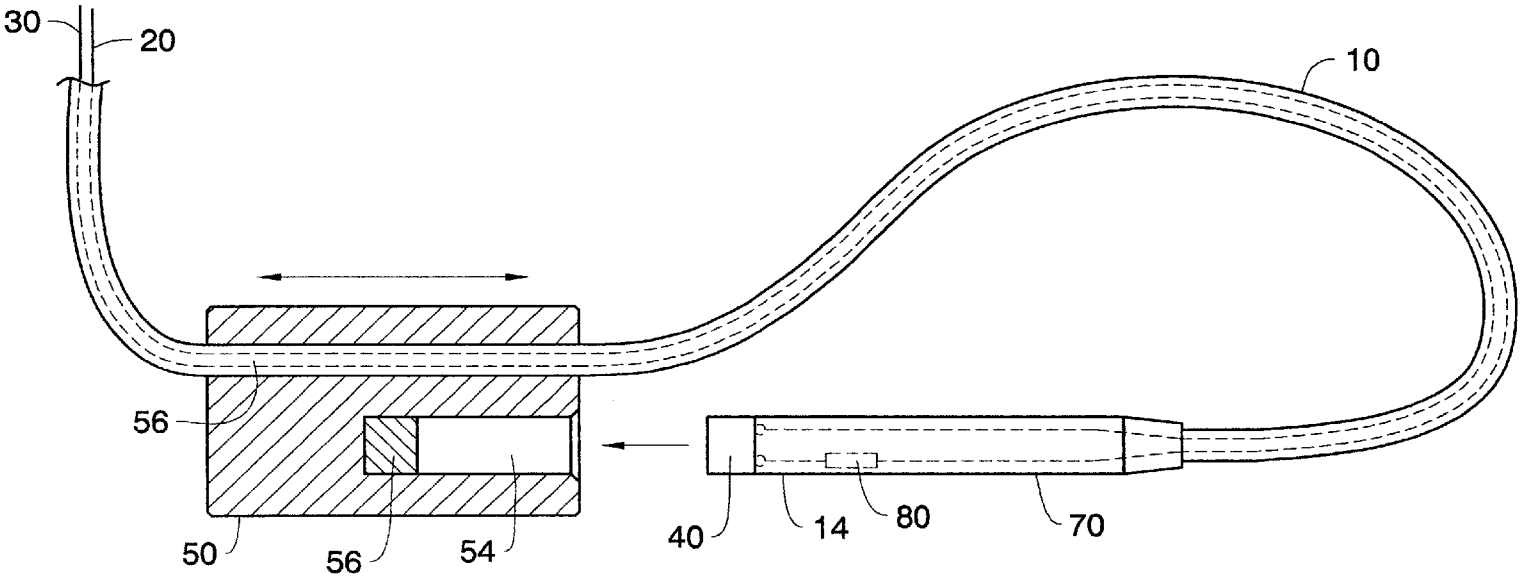
FIG. 2 shows a section view of the preferred looping block with the flexible conduit passing through the conduit shaft.
Figure 4:
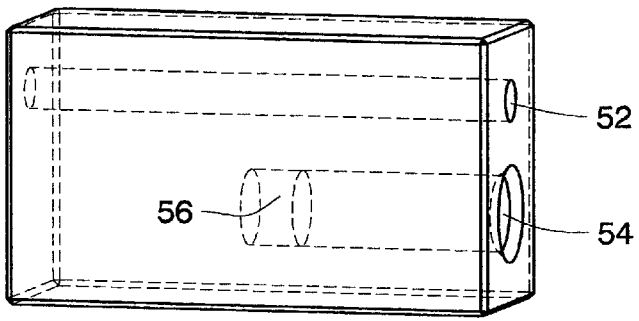
FIG. 4 shows a perspective view of the preferred looping block.
Figure 3:
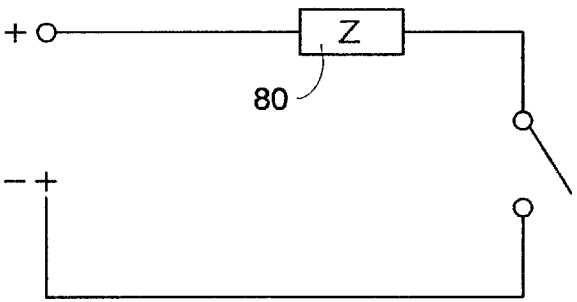
FIG. 3 shows a diagram of the preferred electrical circuit for the security alarm system component.

The security component comprises the following basic elements: flexible conduit 10, a first conductor 20, a second conductor 30, a switch 40, and a looping block 50. As illustrated by FIG. 2, the flexible conduit 10 houses the first and second conductors 20 & 30. Ultimately, the first conductor 20, and the second conductor 30 are connected to the control box. Preferably, the first and second conductors 20 & 30 are connected to the terminals of a plug 62, that is connected to a first end of the flexible conduit 12. The plug 62 is inserted into a plug receptacle of an outdoor junction box 64. The terminals of the plug receptacle are connected to the control box to complete the alarm circuit. When the security component is not in use, a shunt plug can be inserted into the plug receptacle in the outdoor junction box to complete the alarm circuit and the security component can be stored indoors to avoid premature deterioration from exposure to the weather.

The switch 40 is connected to a second end 14 of the flexible conduit 10. The terminals of the switch 40 are connected to the first and second conductors 20 & 30. The switch can be placed inside a plastic or aluminum housing 70 for protection and durability.

The looping block 50 has a conduit shaft 52, a receiving shaft 54, and a switch actuator 56. As shown in FIG. 2, the conduit shaft 52 fully penetrates the looping block 50 so that the flexible conduit 10 adjustably passes (or "slides") through the conduit shaft 52. The receiving shaft 54 does not fully penetrate the looping block 50. The receiving shaft 54 should be large enough so that the second end 14 of the flexible conduit 10 can be inserted into the receiving shaft 54.

A switch actuator 56 is encapsulated within the looping block 50. In the preferred embodiment, the switch actuator 56 is an electrically isolated device that does not conduct electricity. The proximity of the switch 56 actuator to the switch 40 actuates the switch to alter the flow of energy through the first and second conductors 20 & 30 when the second end 14 of the flexible conduit 10 is inserted into the receiving shaft 54. More particularly, the switch 40 is a magnetic reed switch and the switch actuator 56 is a magnet. A magnetic reed switch can be placed inside an aluminum housing for protection and durability.

Figure 1:
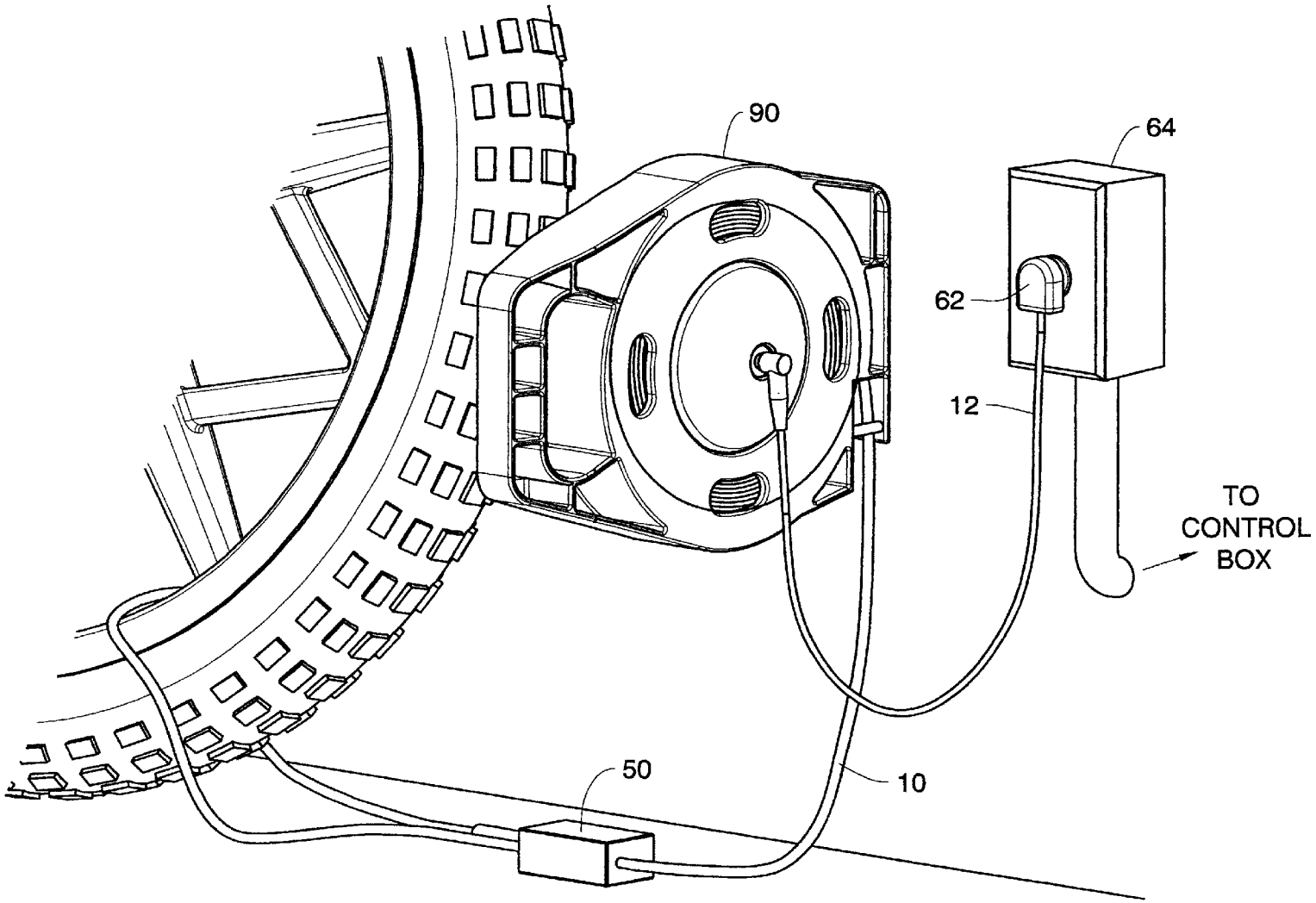
FIG. 1 shows a perspective view of the preferred security alarm system component securing the wheel of a motorcycle.

The looping block's ability to allow the flexible conduit 10 to slide through the conduit shaft 52 is a significant advantage of the invention. The looping block's ability to allow the flexible conduit to slide through the conduit shaft allows an adjustably sized loop to be formed when the second end 14 of the flexible conduit 10 is inserted into the receiving shaft 54. See FIG. 1. This adjustable loop can be formed around any fixed object, or even through an opening of one of the items being secured. For example, the adjustability of the loop allows the security component to be secured around the frame of a bicycle or around the trunk of an oak tree. In addition, the looping block 50 allows the length of the flexible conduit 10 to be approximately half as long as it would need to be if the second end 14 of the flexible conduit 10 had to loop all the way back to the fixed receptacle at the outdoor junction box or some other fixed location.

In a most preferred embodiment, a resistor 80 is inserted into the circuit. The preferred placement of the resistor is at the "end of the line." In this embodiment, the end of line resistor 80 is connected to the first conductor 20 and a terminal of the switch. Alternatively, the resistor can be connected to the second conductor 30 and a terminal of the switch. If an end of line resistor 80 is part of the alarm circuit, the previously described shunt plug should contain the same resistance as the end of line resistor.

In the preferred embodiment, the flexible conduit is stored on a dispensing reel 90. The advantage of the dispensing reel is that it dispenses flexible conduit as required on a case by case basis. For example, a small amount of flexible conduit can be dispensed to secure one bicycle compared to a much larger amount for a fleet of bicycles.

In an alternate embodiment, the switch actuator 56 mechanically actuates the switch 40. In this embodiment, when the second end 14 of the flexible conduit 10 is inserted into the receiving shaft 54, the switch mechanically actuates and alters the flow of energy through the first and second conductors 20 & 30. Likewise, when the second end 14 is removed from the received shaft 54 the switch mechanically actuates again and reverts the flow of energy through the first and second conductors 20 & 30 back to their pre-insertion flow condition.

In yet another embodiment, the switch actuator 56 conducts electricity. In this embodiment, when the second end 14 of the flexible conduit 10 is inserted into the receiving shaft 54, the first and second conductors 20 & 30 are connected inside the looping block 50, which alters the flow of energy through the first and second conductors 20 & 30. Likewise, when the second end 14 is removed from the received shaft 54, the first and second conductors 20 & 30 are disconnected inside the looping block 50 and reverts the flow of energy through the first and second conductors 20 & 30 back to their pre-insertion flow condition.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A security component for use with a security alarm system having a control box, where the control box can (1) apply an energy potential across a first conductor and a second conductor, (2) detect an alteration of energy flow across the first and second conductor, and (3) trigger an alarm after detecting the alteration of energy flow, the security component comprising:

a flexible conduit that houses the first conductor and the second conductor, wherein a first end of the flexible conduit, the first conductor, and the second conductor are connected to the control box;

a switch having a first terminal and a second terminal, wherein the first terminal is connected to the first conductor and the second terminal is connected to the second conductor near a second end of the flexible conduit;

a looping block, the looping block comprising, a conduit shaft that fully penetrates the looping block so that the flexible conduit adjustably passes through the conduit shaft, a receiving shaft that does not fully penetrate the looping block, and a switch actuator that is encapsulated within the looping block, wherein the switch actuator is an electrically isolated device that does not conduct electricity but the proximity of the actuator to the switch actuates the switch to alter the flow of energy through the first and second conductors when the second end of the flexible conduit is inserted into the receiving shaft.

2. The security component of claim 1, wherein the switch is a reed switch and the switch actuator is a magnet.

3. The security component of claim 1, further comprising a resistor connected to the first conductor and either the first or second terminal of the switch.

4. The security component of claim 1, further comprising a resistor connected to the second conductor and either the first or second terminal of the switch.

5. The security component of claim 1, further comprising a dispensing reel for storing and dispensing conduit as needed.

6. For use in a security alarm system comprising an energy potential applied across a first conductor and a second conductor to the terminals of a switch, a flexible conduit that houses the first and second conductors, and a control box capable of detecting an alteration of flow of energy through the first and second conductors, such control box capable of triggering an alarm after detecting the alteration of flow of energy through the first and second conductors, a looping block comprising:

a conduit shaft that fully penetrates the looping block so that the flexible conduit adjustably passes through the conduit shaft;

a receiving shaft that does not fully penetrate the looping block; and, a switch actuator that is encapsulated within the looping block, wherein the switch actuator is an electrically isolated device that does not conduct electricity but the proximity of the switch actuator to the switch actuates the switch to alter the flow of energy through the first and second conductors when a second end of the flexible conduit is inserted into the receiving shaft.

7. The looping block of claim 6, wherein the switch is a reed switch and the switch actuator is a magnet.

8. The looping block of claim 6, further comprising a resistor connected to the first conductor and a terminal of the switch.

9. The looping block of claim 6, further comprising a resistor connected to the second conductor and a terminal of the switch.

10. A security component for use with a security alarm system having a control box, where the control box can (1) apply an energy potential across a first conductor and a second conductor, (2) detect an alteration of energy flow across the first and second conductor, and (3) trigger an alarm after detecting the alteration of energy flow, the security component comprising:

a flexible conduit that houses the first conductor and the second conductor, wherein a first end of the flexible conduit, the first conductor, and the second conductor are connected to the control box;

a switch having a first terminal and a second terminal, wherein the first and second terminals of the switch are connected to the first and second conductors near a second end of the flexible conduit;

a looping block, the looping block comprising, a conduit shaft that fully penetrates the looping block so that the flexible conduit adjustably passes (or "slides") through the conduit shaft, a receiving shaft that does not fully penetrate the looping block, and a switch actuator that is encapsulated within the looping block, wherein the switch actuator actuates electricity when the second end of the flexible conduit is inserted into the receiving shaft, and when the second end of the flexible conduit is removed from the receiving shaft the switch actuates again and alters the flow of energy through the first and second conductors.

11. The security component of claim 10 wherein the switch actuator mechanically actuates the switch.

12. The security component of claim 10 wherein the switch actuator conducts electricity.

13. The security component of claim 10, further comprising a resistor connected to the first conductor and either the first or second terminal of the switch.

14. The security component of claim 10, further comprising a resistor connected to the second conductor and either the first or second terminal of the switch.

15. The security component of claim 10, further comprising a dispensing reel for storing and dispensing conduit as needed.

* * * * *